US005470455A

United States Patent [19]

Santos

[11] Patent Number: 5,470,455

[45] **Date of Patent: * Nov. 28, 1995**

[54] PROCESS FOR CONVERTING ACID SLUDGE TO INTERMEDIATE SLUDGE AND SOFT AND/OR HARD ASPHALT

[76] Inventor: Benjamin S. Santos, 38735 Huntington Cir., Fremont, Calif. 94536

[ * ] Notice: The portion of the term of this patent subsequent to Feb. 22, 2011, has been disclaimed.

[21] Appl. No.: 197,587

[22] Filed: Feb. 17, 1994

Related U.S. Application Data

[63] Continuation-in-part of Ser. No. 879,642, May 7, 1992, Pat. No. 5,288,392.

[51] Int. Cl.[6] ..... C10G 17/02

[52] U.S. Cl. ..... 208/4; 208/6; 208/13; 208/39; 208/179; 208/183

[58] Field of Search ..... 210/710, 721, 210/724, 737, 738, 768, 770, 774; 208/13, 4, 6, 177, 179, 181–183, 39; 106/284.03, 284.04

[56] References Cited

U.S. PATENT DOCUMENTS

| | | | |
|---|---|---|---|
| 3,971,713 | 7/1976 | Ellender, Jr. | 288/206 |
| 4,029,569 | 6/1977 | Ivey, Jr. | 288/180 |
| 4,238,241 | 12/1980 | Schneider | 106/281 |
| 4,331,481 | 5/1982 | Schneider | 106/283 |
| 4,559,128 | 12/1985 | Goodrich | 208/22 |
| 5,049,256 | 9/1991 | Luce | 208/13 |
| 5,288,392 | 2/1994 | Santos | 208/13 |

OTHER PUBLICATIONS

Kirk–Othmer, "Asphalt" Encyclopedia of Chemical Technology, Third Edition, vol. 3, Antibiotics (Phenazines) to Bleaching Agents, pp. 299–302.

Interline Resoures Corporation, "Interline Re–refining Process", Executive Summary, Oct. 1993.

M. L. Whisman, J. W. Goetzinger, and F. O. Cotton, "Petroleum Refinery Engineering", Report of Investigations 7884, Waste Lubricating Oil Research, p. 228.

W. L. Nelson, "Chemical Treatments", Petroleum Refinery Engineering, Fourth Edition, pp. 261/292–297.

English Translation of Patenschrift, DE 42 05 885 Cl, for Bernard Meinken.

English Translation of Offenlegungsschrift, DE 42 05 884 A1, for Bernard Meinken.

N. J. Weinstein, "Disposal of Recovery Process Residues" Waste Oil Recycling and Disposal, Aug. 1974, p. 178.

"Petroleum Products and Lubricants" (1), D–56–D 1660, 1980 Annual Book of ASTM Standards, Part 23, pp. 454–461.

*Primary Examiner*—Neil McCarthy

*Attorney, Agent, or Firm*—Ronald C. Fish; Falk, Vestal & Fish

[57] ABSTRACT

A process for converting the acid sludge produced by waste oil refineries into an intermediate sludge which can be used in the production of either soft, un-oxidized asphalt or hard, oxidized asphalt, and a process for converting the intermediate sludge into soft, un-oxidized asphalt. The process comprises contacting the entire surface area of acid sludge with a pH altering agent such as water or a solid base such as lime, caustic soda, or soda ash, to convert the acid sludge into a layer of liquid and a layer of intermediate sludge. Then the liquid layer is separated from the intermediate sludge layer, thereby producing an intermediate sludge having properties which make it suitable for use in asphalt production. To produce soft, un-oxidized asphalt, the intermediate sludge is heated to a temperature above the boiling point of water and held at that temperature long enough to remove all the aqueous components to create un-oxidized asphalt. Various additives may be added to alter the characteristics or improve the quality of the resulting asphalt.

19 Claims, 12 Drawing Sheets

PROCESS FOR CONVERTING ACID SLUDGE TO INTERMEDIATE SLUDGE AND SOFT AND/OR HARD ASPHALT

This is a continuation-in-part of a United States patent application entitled A PROCESS FOR CONVERTING ACID SLUDGE TO INTERMEDIATE SLUDGE, Ser. No. 07/879,642, filed May 7, 1992, which issued as U.S. Pat. No. 5,288,392 on Feb. 22, 1994.

BACKGROUND OF THE INVENTION

1. Field of the Invention

The present invention pertains to the field of acid sludge disposal and in particular to a process for disposing of acid sludge by converting the acid sludge into a useful compound, specifically asphalt.

2. Description of the Prior art

Because of the huge volume of used crankcase oil from vehicle engines and the oil shortage, an oil recycling industry has grown up. In the prior art, oil recycling generates a toxic byproduct called acid sludge. The volume of acid sludge generated in the recycling process is approximately 20–30% of the volume of the waste oil input. In the prior art, this acid sludge was dumped. However, it is very acidic and it contains many heavy metals and other toxic compounds which are harmful to the environment. Further, acid sludge is not biodegradable. Therefore a need has arisen to process the acid sludge to either eliminate it or convert it to a useful product.

Due to the substantial environmental concerns relating to acid sludge disposal, it is deemed desirable to have a process to convert acid sludge into an intermediate sludge that can be used to create bituminous compounds such as asphalt. Such a process would have far reaching economic and environmental importance. Specifically, the environmental and ecological pollution which results from acid sludge disposal would be reduced.

Acid sludge is a waste product produced by waste oil re-refineries. In the process of re-refining waste oil, one of the goals is to achieve an oil having the qualities of virgin oil.

One method of refining used oil to the quality of near virgin oil requires treating the oil with sulfuric acid. Sulfuric acid is added to oxidize and remove carbonaceous impurities, metal components and other oxidizable materials from the used oil. The addition of sulfuric acid causes a phase separation to occur in which there is generated a layer of relatively pure oil and a layer of acid sludge. The acid sludge settles and is removed. In this used oil refining process, the acid sludge is approximately 5% by volume of 98% sulfuric acid and has a pH less than 2 and typically a pH of 0.1. Consequently, this acid sludge is highly acidic, is considered toxic, and is not biodegradable. Disposal of this sludge is increasingly regulated by the environmental protection agencies of most federal and state governments. In addition, during these re-refining processes, large volumes of acid sludge are produced. The volume of acid sludge produced is approximately 0.25 gallons per gallon of used oil. In the years preceding 1980 this amounted to over 2 million tons of acid waste per year. Today, the volume of acid sludge may even be greater, but this is unclear.

Traditional methods of acid sludge disposal are landfill, incineration, acid recovery, neutralization, and disposal to water. These disposal options have a number of drawbacks. For example, as much as 30 to 50% of the acid sludge is water soluble. Therefore if the acid sludge is disposed of in a landfill, components of the sludge can leach into the water table and cause hazardous health conditions. In addition, incineration and neutralization of acid sludge produce toxic gaseous emissions to the atmosphere. These emissions include sulfur and sulfur dioxide which are leading causes of acid rain which is causing great damage to Canadian, English and Scottish forests. Acid recovery from the acid sludge is too expensive on the small scale and the high transportation costs make justification of a centralized location very difficult. Finally disposal to waste water can only be practiced where high volume waste water treatment facilities are available for dilution.

These traditional methods of disposal are very detrimental to the environment. In addition these traditional methods are becoming more and more costly as the regulatory requirements governing them increase.

There are prior art processes which combine acid sludge with other compounds to produce asphalt. (Schneider U.S. Pat. Nos. 4,238,241 and 4,331,481). These processes involve adding the acid sludge to pre-existing asphalt or to a mixture of asphalt and aggregate. The acid sludge used is only a small fraction of the end product. Therefore, these processes fail to use significant amounts of the acid sludge and, consequently, they do not significantly decrease the amount of acid sludge in existence.

SUMMARY

According to the teachings of the invention, a process for converting acid sludge to asphalt is provided. The first step in this process is to raise the pH of the acid sludge. This is done by altering the pH of the acid sludge by adding a pH elevating agent to the acid sludge. The pH elevating agent has a pH ranging from 3–14, and the volume and pH of the pH elevating agent are selected so as to be sufficient to raise the pH of said acid sludge to a range from approximately 3 to approximately 7. The pH of the acid sludge must be raised to a level such that the acid sludge does not become sandy and un-meltable at temperatures from room temperature up to approximately 275 degrees centigrade. This pH elevation process creates an intermediate mixture comprising a layer of liquid and a layer of intermediate sludge having a pH in the range from 3–7.

Generally any agent may be mixed with the acid sludge to raise its pH, although there are some restrictions. Generally, the preferred agents are water, acid of a higher pH, or weak or strong bases and salt solutions in that order. Solid pH elevation agents may also be used such as lime, caustic soda, or soda ash, or any other inorganic solid with a pH higher than 3 after said solid pH elevating agent is reacted in any solvent such as water. Generally, solid pH elevating agents may be added either alone or they may be first dissolved in solvent and then added. Dissolving the solid pH elevating agent in a liquid helps disperse the agent better, but is not absolutely essential because one by-product of dissolving a base such as lime, caustic soda, or soda ash with an acid is water, so there will be some liquid to help disperse the pH elevating agent and dissolve it anyway even if the solid base is not first dissolved in a solvent.

The acid sludge, after raising its pH, is an intermediate sludge which can be used to create various asphalt species such as soft asphalt and "blown asphalt," or hard, oxidized asphalt that is commercially valuable. The process to convert soft asphalt to "blown asphalt" is known in the prior art. However, a process to create soft or hard asphalt from acid sludge is not known in any prior art of which the applicant is aware.

According to one aspect of the teachings of the invention, blown asphalt is created by oxidizing the intermediate sludge generated from the acid sludge in accordance with the above described process. Generally this process of creating blown asphalt from the intermediate sludge involves heating the intermediate sludge to 200–270 degrees centigrade, preferable 230 degrees centigrade, and blowing air through it for approximately 10–20 hours. The air flow rate is preferably 50 cubic feet per minutes. Higher air flow rates or higher temperatures shorten the time necessary to produce "blown asphalt." The preferable penetration number indicative of the desired hardness of the resulting asphalt is 6–25, but higher penetration numbers are also useful. For example, penetration numbers up to 100 are also useful species of this type of asphalt. Blown asphalt is typically used in roofing and other waterproofing or waterproof coating applications.

Soft or un-oxidized asphalt can also be created from the intermediate sludge. Un-oxidized asphalt are useful in road paving and underlaying or undersealing applications, for vapor barrier and as raw material for the creation of blown asphalt. To create un-oxidized asphalt from the intermediate sludge, the intermediate sludge is heated to evaporate the water therein. The preferred temperature range for this evaporation process is 200–275 degrees centigrade. Different species of unoxidized asphalt can also be created by adding various additives. Specifically, virgin asphalt stocks can be added to widen the applications of the resulting un-oxidized asphalt such as for use in road paving, rust preventive coatings, etc. Further, the un-oxidized asphalt, either with or without the addition of virgin asphalt stocks, can be made into a wide variety of other products by the addition of various additives. For example, rubber or rubber compounds can be added to produce rubberized asphalt which is useful in waterproofing applications and in road paving.

Further, resins or other classes of polymers can be added to the un-oxidized asphalt to enhance the quality of the resulting soft asphalt. Also, solvents can be added to the un-oxidized asphalt to produce cutback asphalt which is useful as a primer for road pavement. Water and emulsifier can be added simultaneously to produce emulsified asphalt which is also useful as primer for road pavement.

DETAILED DESCRIPTION OF THE PREFERRED EMBODIMENT

Figure 1:
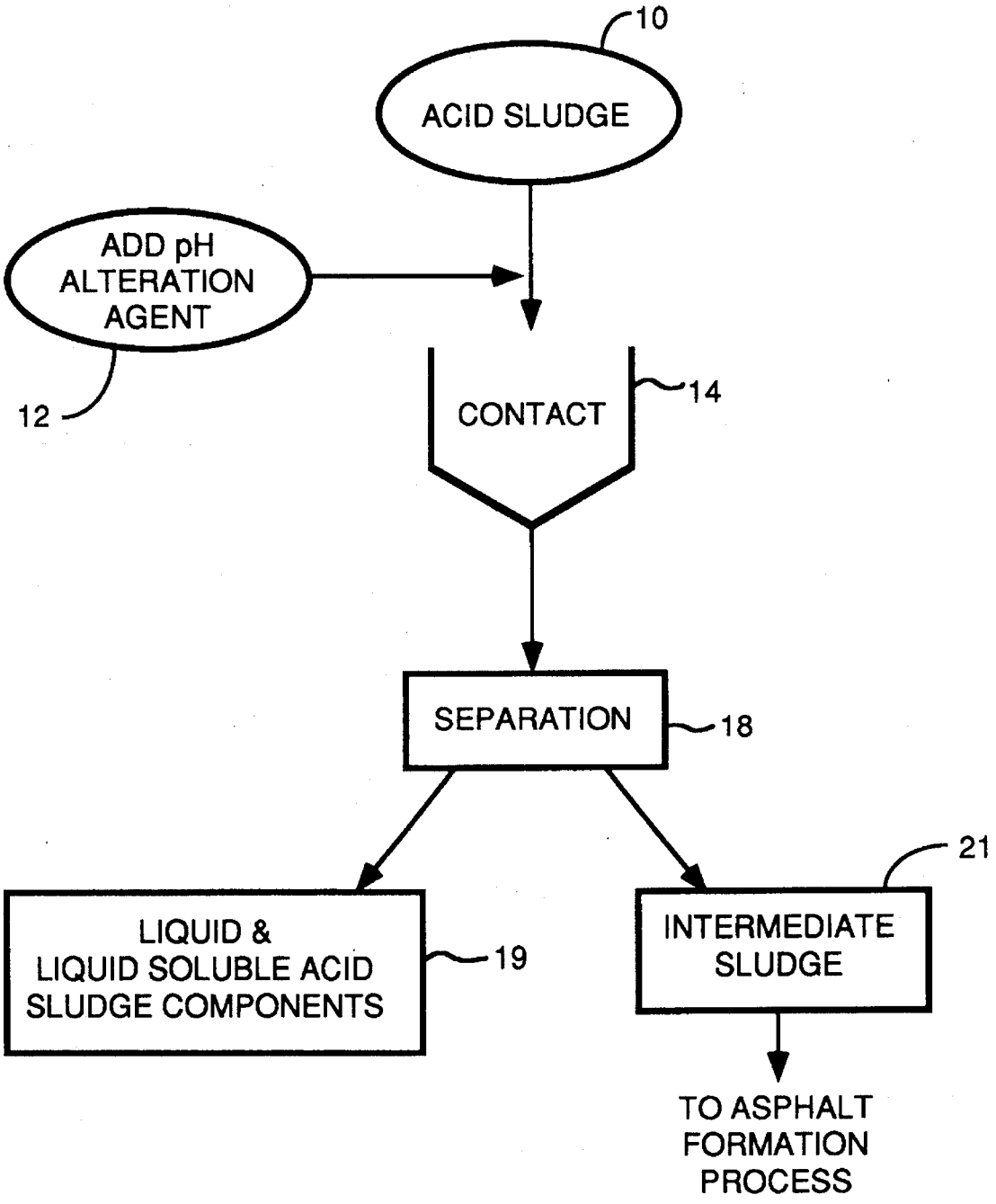
FIG. 1, is a schematic diagram of the conversion process of the present invention.
Figure 4:
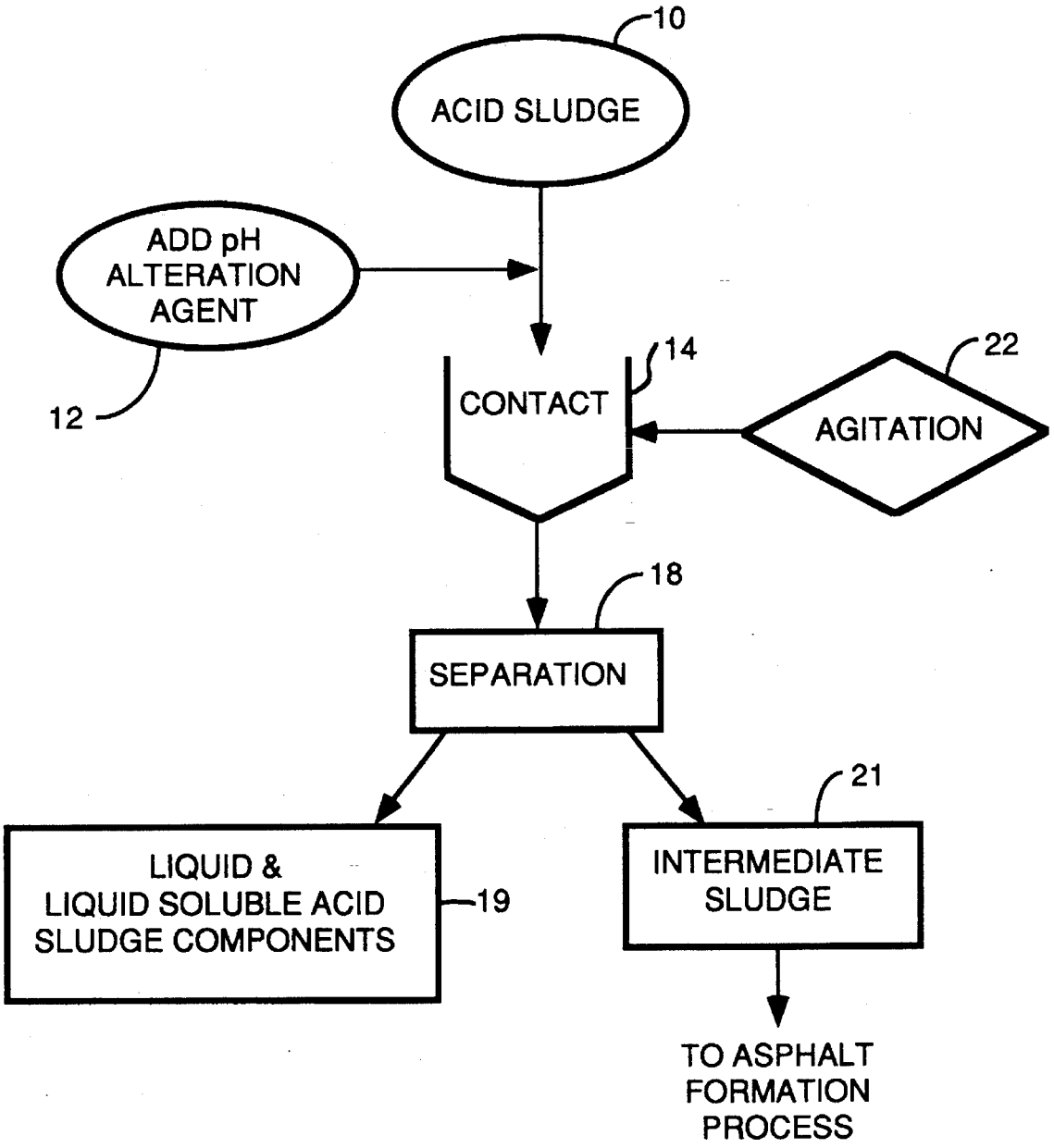
FIG. 4, is the schematic diagram of an alternative embodiment of the conversion process in FIG. 1 wherein the contacting step is enhanced through agitation.

Referring to FIG. 1, the present invention is a process for converting acid sludge into an intermediate sludge which can be converted by known methods into an asphalt mixture. Specifically, soft "un-oxidized" asphalt can be produced simply by evaporating the water from the intermediate sludge. Oxidized or so-called "blown asphalt" can be created by heating the intermediate sludge to remove the water content and then bubbling air or oxygen through the resulting soft or un-oxidized asphalt for a time sufficient to raise the penetration number of the resulting oxidized asphalt to from 4–25, although higher penetration numbers up to about 100 are also useful. The process according to the teachings of the invention will enable acid sludge to be utilized in a useful manner and will eliminate the need to dispose of toxic acid sludge with all the attendant disposal problems that entails. A process according to the teachings of one aspect of the invention comprises: providing acid sludge, symbolized by step 10; contacting the acid sludge with an agent to increase the pH of the acid sludge, such as a liquid or solid of sufficient pH so as to produce a mixture which is both non-granular at room temperature and non-granular when subjected to heating as symbolized by steps 12 and 14 in FIG. 1; and separating the pH altering agent from the mixture, as symbolized by steps 18, 19 and 21. These two steps of introducing the pH modifying agent and contacting it with the acid sludge create an intermediate sludge which is useful in the production of oxidized or un-oxidized asphalt. The notation "to asphalt formation process" in FIGS. 1, 4 and 5, means to any process by which either soft un-oxidized asphalt or hard oxidized asphalt may be formed.

The starting material for the process of the present invention is acid sludge that is generated in the process of re-refining used lubricating oil. Generally the acid sludge is a byproduct of the re-refining process resulting from the addition of sulfuric acid to the waste oil. The sulfuric acid sludge are difficult to define chemically, but typically they can contain sulfuric acid esters, sulfonic acids, salts of nitrogen bases, resinous and asphaltic materials, sulfur compounds dissolved from the oil, hydrocarbon polymers, condensation products and entrained oil. The composition varies with the nature of the oil fraction, treating conditions and time of storage.

The acid sludge that is the starting material in the present process can be acid sludge from any oil refining process that utilizes acid. One oil re-refining process is acid-clay re-refining of used mineral lubricating oil (industrial or automotive). Alternatively, the acid sludge could be an acid sludge that has been in a temporary holding pit or the like. Generally the acid sludge will have a pH of about ≦3 and, typically, will have a pH of 0.1.

It is desirable to convert the acid sludge into a higher pH intermediate sludge to make it useful for formation of useful end products such as un-oxidized or oxidized "blown asphalt". "Blown asphalt" is a particular species of asphalt having significant commercial value for roofing and other such waterproofing applications such as vapor barriers. The process to make this oxidized asphalt requires heating to a high enough temperature so as to remove aqueous components from the intermediate sludge to convert it to soft asphalt. Unfortunately the level of heat required will immediately turn acid sludge having a pH of approximately 0.1 into a sandy mixture which will not melt. Such sandy mixtures are not useful in making asphalt.

Figure 2:
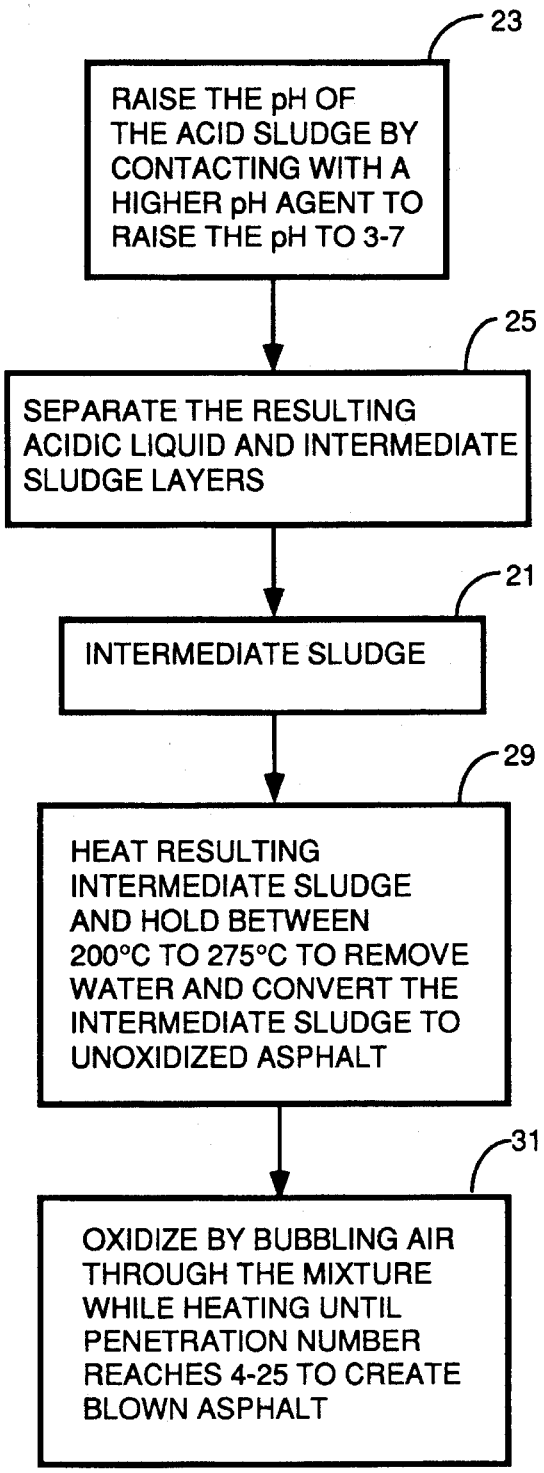
FIG. 2 is a process flow diagram of a process according to the invention using a liquid pH alteration agent.

Therefore, according to the teachings of the invention, the pH of the acid sludge material is increased by contacting the acid sludge with a pH altering agent to raise the pH to a level such that the sludge will not be granular at room temperature nor become granular upon heating. FIG. 2 is a process flow diagram showing the preferred process for converting acid sludge to blown asphalt. The process comprises the steps of: raising the pH of the acid sludge to approximately 3–7 by contacting it with a liquid pH altering agent having a pH preferably from 3–14 as symbolized by step 23; separating the resulting liquid pH altering agent and intermediate sludge layers as symbolized by step 25; heating the intermediate sludge (21) to a temperature between 120° C. and 275° C. as symbolized by step 29 to remove the aqueous components thereby converting the intermediate sludge to a soft or un-oxidized asphalt useful for many different applications; and, oxidizing the resulting un-oxidized asphalt until the penetration number reaches 4–25, as symbolized by step 31. Higher penetration numbers up to 100 are also useful.

The step of raising the pH of the acid sludge is symbolized by step 23. Preferably the step of raising the pH is performed by contacting the acid sludge with a liquid having a pH significantly higher than 0.1, and preferably higher than about 3. In other embodiments, the agent used to raise the pH can be a solid. The preferred agent is water which is mixed with the acid sludge to serve the function of increasing the pH thereof to a level sufficient to prevent formation of granules upon heating but not raising the pH so high as to create granules at room temperature.

The pH of the pH altering agent utilized in the present invention bears a functional relationship with the acid sludge. If the pH altering agent has a pH which is too high or if too much pH altering agent is added, as indicated above, the acid sludge will become granular at room temperature. On the other hand, if the pH of the pH altering agent is too low, the sludge will become granular when the temperature of the mixture is elevated. Accordingly, the pH of the added pH altering agent must be sufficient to cause the pH of the acid sludge to increase to a pH in the range of generally from about 3–7.

The liquid pH altering agent can be selected from the group comprising water, other inorganic liquids, organic liquids, and dilute acids or bases. In particular, the pH altering agent can be selected from the group comprising: dilute strong acids, weak acids, salt solutions and dilute bases such as: lime, ammonia, caustic soda or soda ash and the like. Preferably the pH altering agent is of pH in the range of from 3–14. Most preferably the pH altering agent is water. Some of the characteristics which make water a preferred pH altering agent are that water is generally inexpensive and has pH 7.

The amount of pH altering agent required in the process of the present invention will depend upon the initial pH of the acid sludge, the amount of the acid sludge and the pH of the pH altering agent being used. The amount of pH altering agent will be that quantity which is necessary to remove or neutralize the residual sulfuric acid in the acid sludge and thereby increase the pH of the acid sludge to a pH sufficient to meet the functional granularity requirements stated above, generally in the range of from 3–7. Thus, the amount of the pH altering agent, like the pH of the agent, is situation dependent. For example, if the pH altering agent is water, the volume of water should be approximately 3 to 7 times the volume of acid sludge. On the other hand, if the pH altering agent is a caustic liquid, i.e.; a liquid having a pH greater than 7, less pH altering agent will be required.

Since all of the components of acid sludge are not soluble in the liquid pH altering agent, the liquid pH altering agent and acid sludge will not form a homogenous mixture. In the absence of agitation, the liquid pH altering agent and the acid sludge will form two layers. Therefore, in the process of the present invention, after the acid sludge has been sufficiently contacted with the pH altering agent, the liquid pH altering agent and the acid sludge will separate and form two layers: a liquid layer and an intermediate sludge layer. The sulfuric acid and other water soluble components of the acid sludge starting material are now present in the liquid layer. This liquid layer is removed from the acid sludge and disposed of as symbolized by step 18 in FIG. 1 and step 25 in FIGS. 2 and 3A. Processes by which the acid liquid layer can be removed from the acid sludge include decanting, removing by suction, separating and the like. The process of contacting the liquid pH alteration agent with the acid sludge followed by liquid layer removal is continued until the pH of the acid sludge is generally in the range of from 3–7. The pH of the resulting intermediate sludge can be measured via the strong acid number. The methods for performing strong acid number measurement are well known by those skilled in the art. A standard test method can be found in the 1980 Annual Book of ASTM Standards D974, pad 23, Petroleum Products and Lubricants. This method measures strong acid number by placing a sample of the acid sludge in boiling water. The pH of this water can also be measured by using a pH test paper covering the full range of pH from 1–14 or by using a pH meter.

Figure 3A:
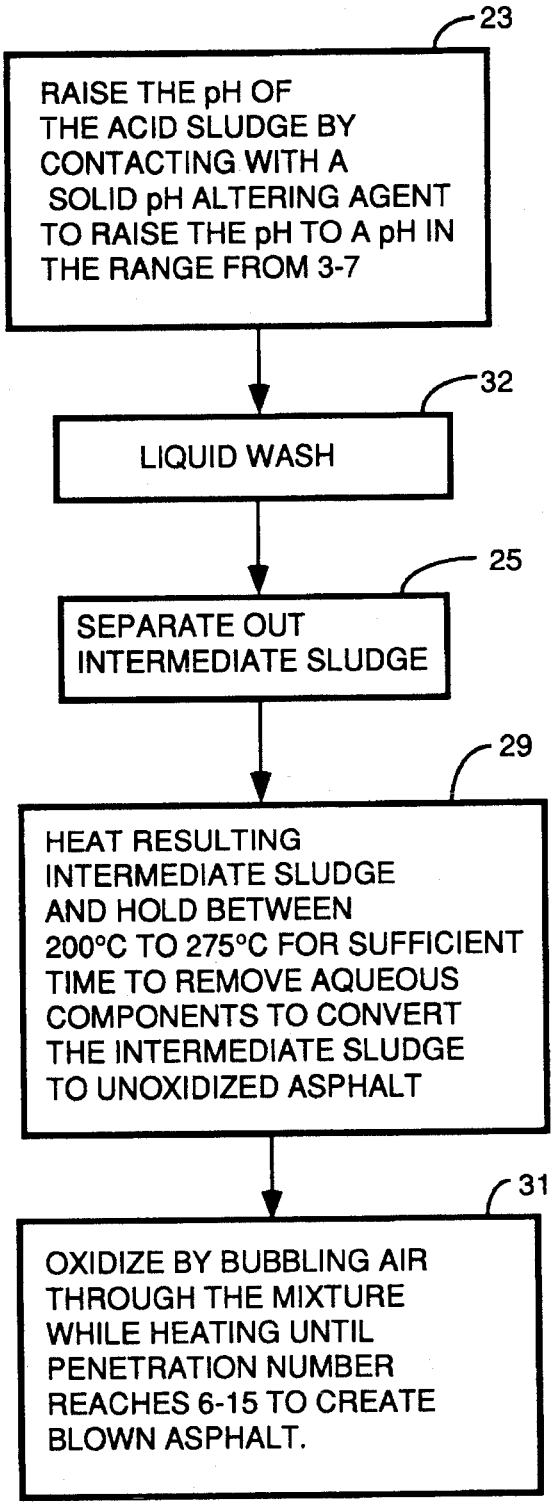
FIG. 3A is a process flow diagram of a process according to the invention to convert acid sludge to blown asphalt using a solid pH altering agent and including a liquid wash step.

FIG. 3A is an alternative process flow diagram wherein a solid pH altering agent is used. Typical solid pH altering agents include lime, caustic soda, soda ash and the like. The solid pH elevating agent can be any organic or inorganic solid which can be directly mixed in with the acid sludge to raise its pH or which can be mixed with some solvent to make a liquid pH elevating agent that is then mixed with the acid sludge. Some inorganic solid pH elevating agents such as lime, caustic soda and soda ash can be directly mixed with the acid sludge as solids and will raise the pH of the acid sludge. This is because the natural reaction of these solids with the acid sludge is to form water and salts. The water helps disperse the solid pH elevating agent throughout the acid sludge to more thoroughly mix it.

Many other types of solid pH elevating agents may also be used to raise the pH of the acid sludge, but with many of these inorganic solids such as calcium carbonate, it is necessary to dissolve the solid pH elevating agent in a solvent first before mixing the resulting liquid pH elevating agent with the acid sludge. Therefore, step 23 in the flow charts of FIGS. 3A and 3B should be understood as requiring the solid pH elevating agent to be dissolved in some solvent first before mixing with the acid sludge in cases where the particular solid pH elevating agent selected does not naturally form enough water in the reaction to effectively disperse the pH elevating agent thoroughly throughout the acid sludge. The resulting liquid pH elevating agent should have a pH higher than 3 after the solid pH elevating agent is dissolved in any solvent such as water.

It is generally true that water is a by-product of a reaction between any base and an acid. As such, it may not be necessary in every case of use of a solid pH elevating agent to dissolve the solid in water before mixing the resulting liquid with the acid sludge. However, in some cases it is preferable to dissolve the solid in water before mixing the resulting liquid pH elevating solution with the acid sludge so as to enhance the mixing of the pH elevating agent with the acid sludge for more complete reaction.

The solid pH altering agent is contacted with the entire surface area of the acid sludge in the same process as the liquid pH altering agent. However, when a solid pH altering agent is used, there is not a free liquid layer as there is when a liquid pH altering agent is used. When solid pH altering agents, such as caustic soda, lime, etc. are used, they react with the sulfuric acid to form salts and water. Therefore, after the solid is added, the mixture is washed (step 32) with liquid, usually water to remove the residue formed by the solid and then this liquid is separated (step 25) from the acid sludge. The wash step 32 also removes salts formed in the mixture when the solid pH elevating agent reacts with the acid sludge to form water and salts. The washing step also tends to make the reaction between the solid pH elevating agent and the acid sludge more complete by virtue of more thorough distribution of the solid pH elevating agent throughout the acid sludge. After washing and separating, the process of FIG. 3A proceeds in the same manner as the process of FIG. 2.

Figure 3B:
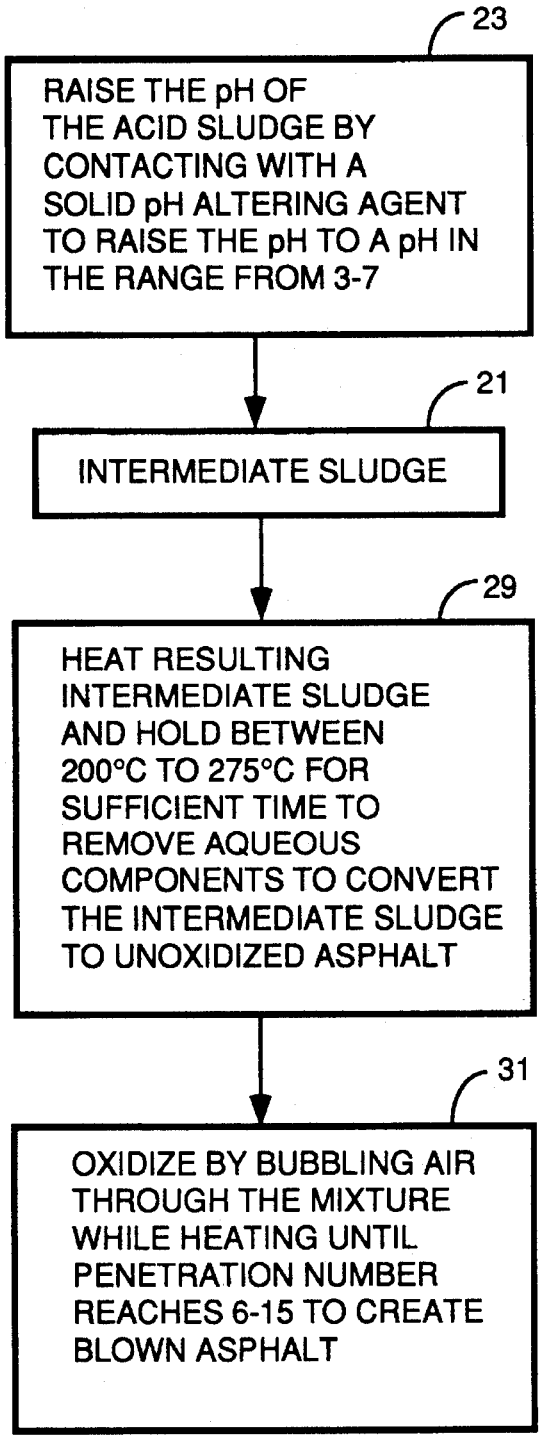
FIG. 3B is a process flow diagram of a process according to the invention to convert acid sludge to blown asphalt using a solid pH altering agent.

Alternatively, after solid pH altering agents are added to the acid sludge, the resulting mixture may be heated as symbolized by step 29 in FIG. 3B without undergoing washing and separating steps symbolized by steps 32 and 25 in FIG. 3A. This heating removes the aqueous components to convert the intermediate sludge into soft or un-oxidized asphalt. Thereafter, the process of FIG. 3B proceeds in the same manner as the process of FIG. 3A.

Both the processes symbolized by the flow charts of FIGS. 3A and FIG. 3B represent processes to create oxidized or blown asphalt from acid sludge. Step 29 must result in removal of substantially all the water in the intermediate sludge before the oxidation process starts to result in good quality blown asphalt. High quality blown asphalt must have a moisture content of approximately zero. Likewise, high quality un-oxidized soft asphalt must also have a moisture content of approximately zero. Therefore, the process steps 23, 25 and 29 in the processes of FIGS. 3A and 3B to make high quality blown asphalt with solid pH elevating agent are identical to the process steps needed to make high quality soft or un-oxidized asphalt with solid pH elevating agent. Therefore, two processes for making un-oxidized soft asphalt from acid sludge using solid pH elevating agents are represented by FIGS. 3A and 3B by simply removing step 31 in each figure.

Preferably the entire surface area of the acid sludge should be contacted with the pH altering agent. Therefore, in the preferred embodiment, the pH altering agent-acid sludge mixture is agitated, as symbolized by step 22 in FIGS. 4 and 6. Agitating the pH altering agent/acid sludge mixture will increase the degree of contact between the pH altering agent and the entire surface area of the acid sludge. The agitation should be sufficiently adequate so as to disperse the pH altering agent throughout the acid sludge. Some agitation processes include mixing, stirring, dispersion, vibration, shaking, milling, rolling, blending and the like.

Figure 5:
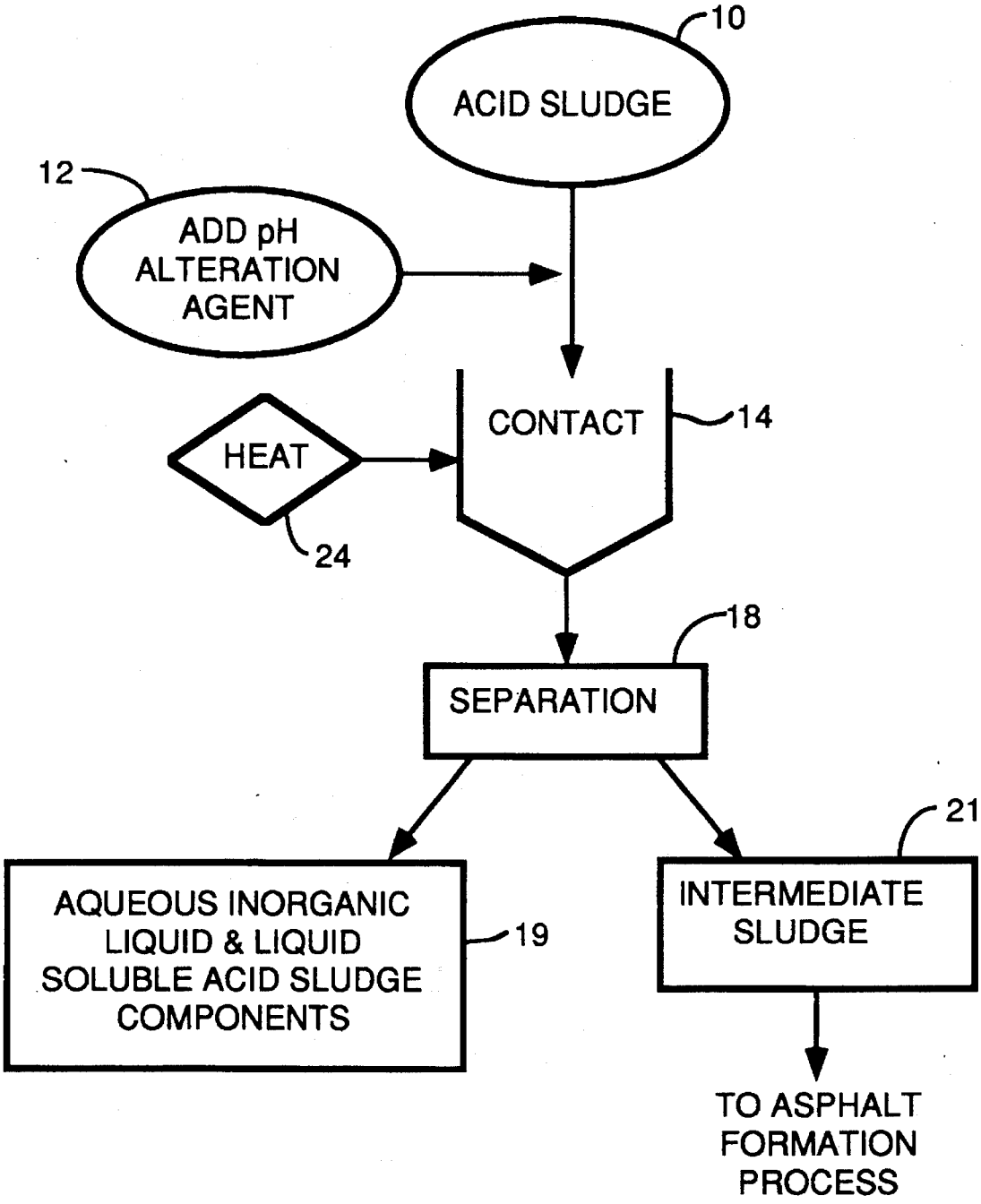
FIG. 5, is the schematic diagram of an alternative embodiment of the process shown in FIG. 1, wherein the contacting step is enhanced through heating.
Figure 6:
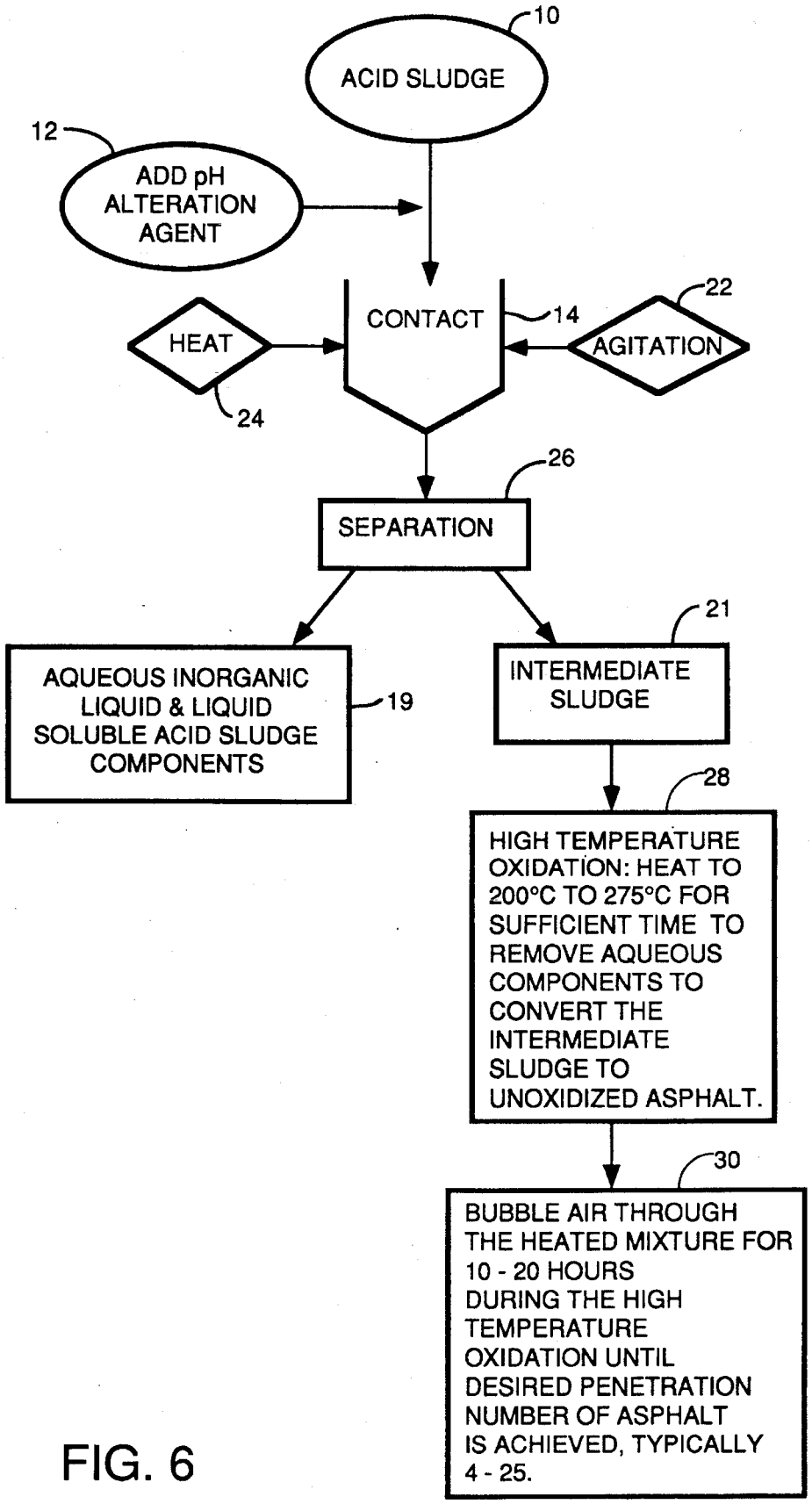
FIG. 6, is the schematic diagram of an alternative embodiment of the process shown in FIG. 1, wherein the contacting step is enhanced through agitation and heating and further detailing the process steps to convert the intermediate sludge to blown asphalt.

In another embodiment, the temperature of the pH altering agent-acid sludge mixture is elevated during the step of contacting the pH altering agent with the acid sludge as symbolized in FIGS. 5 and 6, by step 24. Acid sludge is very viscous and will not readily mix with the pH altering agent. Therefore, the temperature of the sludge can be elevated, at least during the interval of adding pH altering agent and contacting, to ease mixing thereby increasing the amount of acid sludge surface area with which the pH altering agent is contacted. Although the temperature is not critical, best results were obtained using a temperature greater than 100 degrees centigrade and preferably 190 degrees centigrade.

Referring to FIG. 6, there is shown a process for converting acid sludge to blown asphalt. The process of FIG. 6 comprises: providing acid sludge (step 10), contacting the acid sludge with a pH altering agent (steps 12 and 14), agitating and heating the pH altering agent/acid sludge mixture (steps 22 and 24), separating the liquid pH altering agent layer from the intermediate sludge layer to remove the liquid (step 26), heating the intermediate sludge to a temperature in the range from 200–275 degrees centigrade for a time sufficient to remove the aqueous components from the intermediate sludge thereby converting the intermediate sludge to soft or un-oxidized asphalt (step 28), oxidizing the intermediate sludge by bubbling air through the heated mixture, preferably at a rate of 50–150 cubic feet/minute per ton for an interval from 10–20 hours to form an oxidized or blown asphalt (step 30). The oxidation continues until the penetration number is in the range from 4–25 and preferably from 8–10 although oxidized asphalt with penetration numbers up to 100 are also useful. The amount of time this takes depends upon the temperature selected and the rate of air flow through the intermediate sludge. For example, air blowing for approximately 10 hours at a temperature of 250° C. and an air rate of 50 cubic feet per minute will generally result in an asphalt mixture having an approximate penetration of 8 when measured at 25° C., 100 grams and 5 seconds, a R & B softening point of 100° C., and a flash point of 250° C. Higher temperatures or higher flow rates result in shorter intervals.

The purpose of the pH modification steps 12 and 14 are to avoid granularity problem which would prevent the melting necessary to form asphalt. The purpose of the heating step 28 is to drive off the aqueous compounds. The purpose of the oxidation step 30 is to make the resulting asphalt harder and more brittle.

In a preferred embodiment, the steps 28 and 30 comprise raising the temperature of the intermediate sludge to 270 degrees centigrade to drive off the water, and blowing air through the heated mixture at a rate of 150 cubic feet per minute for 10 hours.

Asphalt are graded according to their penetration number and softening point. Typically soft asphalt have penetration numbers of 60–150 and above, and hard asphalt have penetration numbers of 4 to 20 or 25 although oxidized asphalt having penetration numbers higher than 25, possibly as high as 100 exist and are useful and are still within the class of oxidized asphalt although their penetration number falls within the range of penetration numbers typically found in the class of un-oxidized asphalt.

The resulting asphaltic mixture of bituminous compounds and chemical, can then be used in a number of applications. For example the asphaltic mixture of the present invention can be used in the production of soft or hard asphalt, water-proofing, rust prevention, vapor barrier, undercoating, underlaying or undersealing, priming and painting, insulation, lamination, battery sealant and paving materials. A particularly beneficial use of the bituminous compound produced by this process is the ability it has to form a hard asphalt mixture. In addition, the intermediate sludge could be added to soft asphalt to make the soft asphalt harder.

Figure 7:
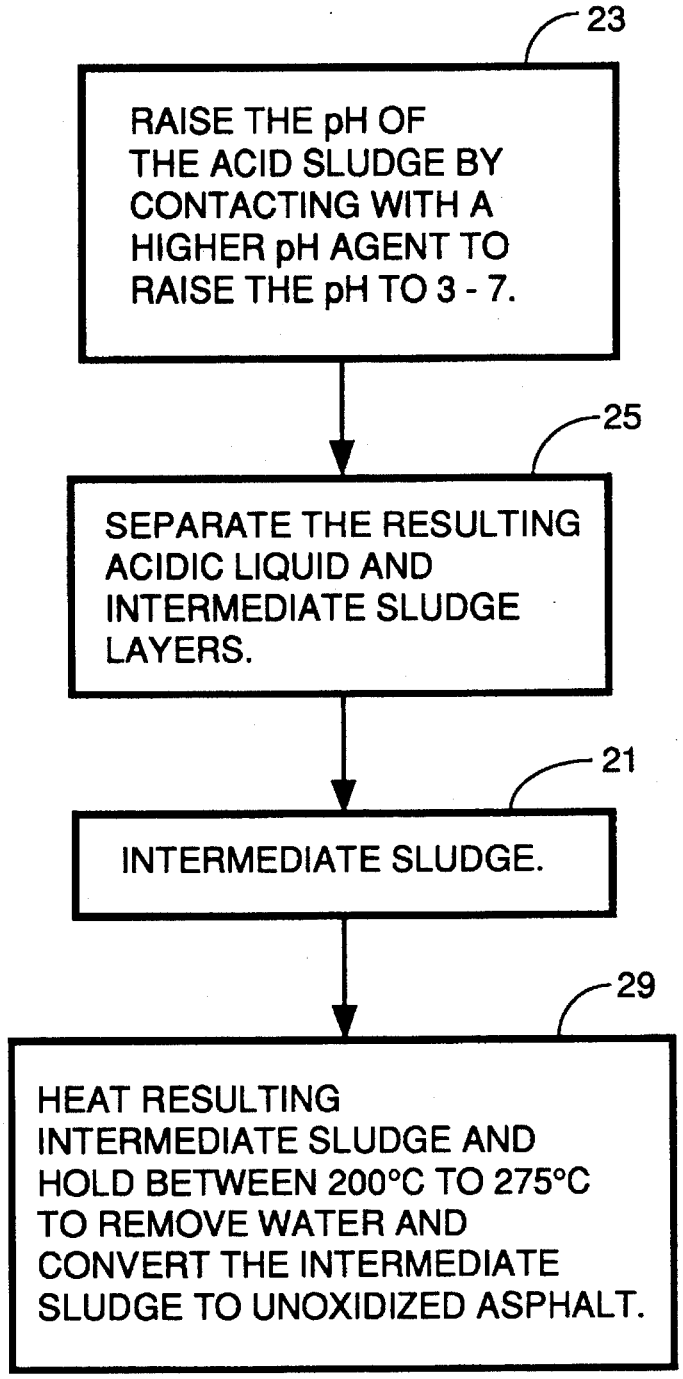
FIG. 7 is a flow chart of the basic process to convert acid sludge into soft asphalt.

Referring to FIG. 7, there is disclosed a flow chart for a process for converting acid sludge to soft, un-oxidized asphalt. The process for making unoxidized asphalt from acid sludge is identical to the process of making oxidized asphalt except for the final step of oxidation. Accordingly, steps 23, 25, 21 and 29 in FIG. 7 are the same as previously described in reference to a description of the process for making oxidized asphalt in FIG. 2 except that there is no step of bubbling air or oxygen through the heated intermediate sludge. The discussion above given for steps 23, 25, 21 and 29 is hereby incorporated by reference. Basically, the intermediate sludge is soft, un-oxidized asphalt mixed with water. This water is driven off in step 29 where the intermediate sludge is heated to a temperature sufficiently high to evaporate water from said intermediate sludge, typically between 120° C. to 275° C. (or any other temperature suitable to drive off the water completely). The sludge is held at this elevated temperature for a time sufficient to remove substantially all the water content. The upper temperature is not critical because the resulting asphalt will simply melt. However, the temperature should not be so high as to crack the hydrocarbon compounds that make up the un-oxidized asphalt.

Figure 8:
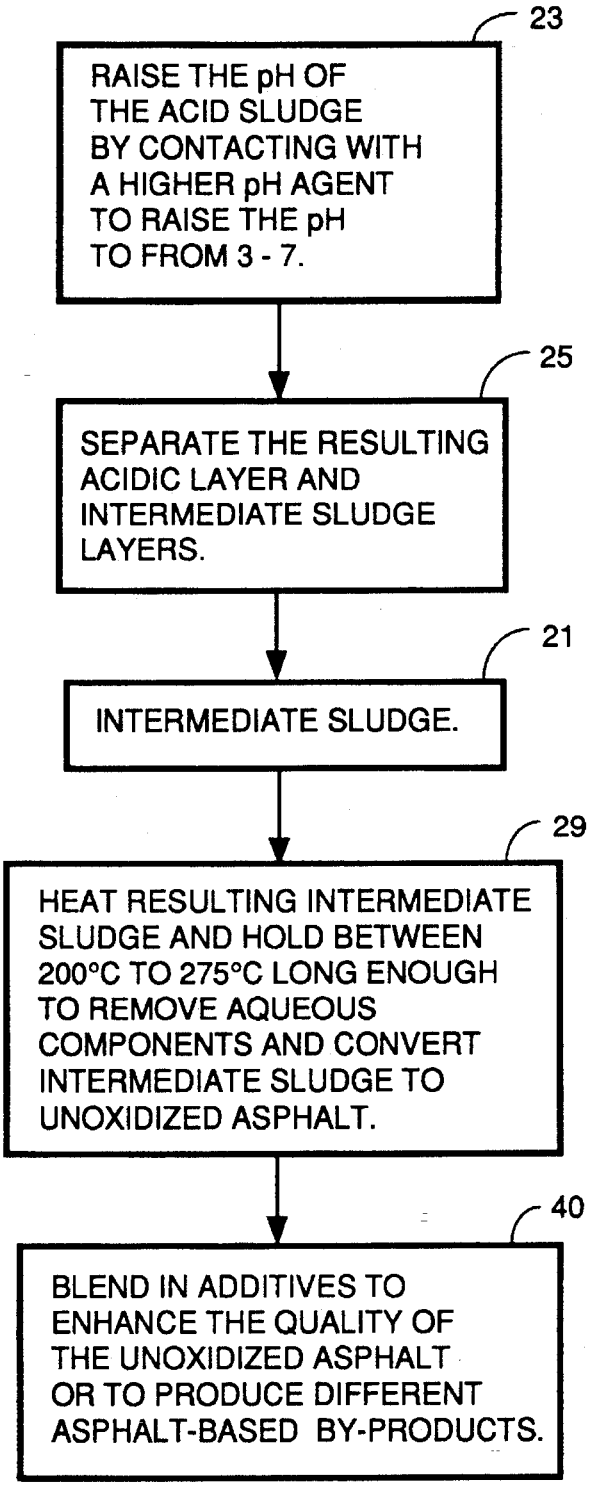
FIG. 8 is a flow chart of an alternative embodiment of the basic process to convert intermediate sludge into soft, un-oxidized asphalt either with or without the addition of additives.

Referring to FIG. 8, there is shown another species of the class of processes according to the teachings of the invention for making soft asphalt from acid sludge. In the process of FIG. 8, all the steps 23, 25, 21 and 29 are identical to the like numbered steps in FIGS. 2 and 7. The difference between the process of FIG. 7 and the process of FIG. 8 is in an optional final step symbolized by block 40 where various additives may be blended into the soft asphalt to enhance its quality for wider application or produce a different asphalt based by-product. This same optional step 40 is also found in the process of FIG. 11 where a solid pH elevating agent is used to raise the pH of the acid sludge and convert it to intermediate sludge. These additives are preferably added after heating the intermediate sludge to drive off the water because this saves on energy costs in not requiring heating of the additives themselves. However, the additives may also be added before heating the intermediate sludge in some embodiments. Preferably, the additives are added after the un-oxidized asphalt is cooled, but they may also be added while the un-oxidized asphalt is hot so long as the heat will not damage the additive or change its chemical composition. Generally, the additives are of such a nature that the heat will not damage or alter them.

Typical additives are virgin asphalt stocks to improve the quality of the resulting un-oxidized asphalt to widen the applications for which the resulting product is useful such as in road paving, or vapor barrier applications or as rust preventative coatings, etc. The soft, un-oxidized asphalt, either with or without the addition of the virgin asphalt, may also have added to it such things as:

- rubber or rubber compounds to produce rubberized asphalt which is typically useful in waterproofing and road paving applications as a sealer for concrete surfaced roads or in asphalt road construction;
- resins or other polymer additives which are typically useful to enhance the adhesion qualities of the resulting soft asphalt;
- solvents to produce cutback asphalt which is typically useful as a primer or undercoating in either concrete or asphalt road paving and is also useful for other applications;
- water and emulsifier agents to produce emulsified asphalt which is typically useful as a primer or undercoating for asphalt or concrete road surfaces.

Figure 9:
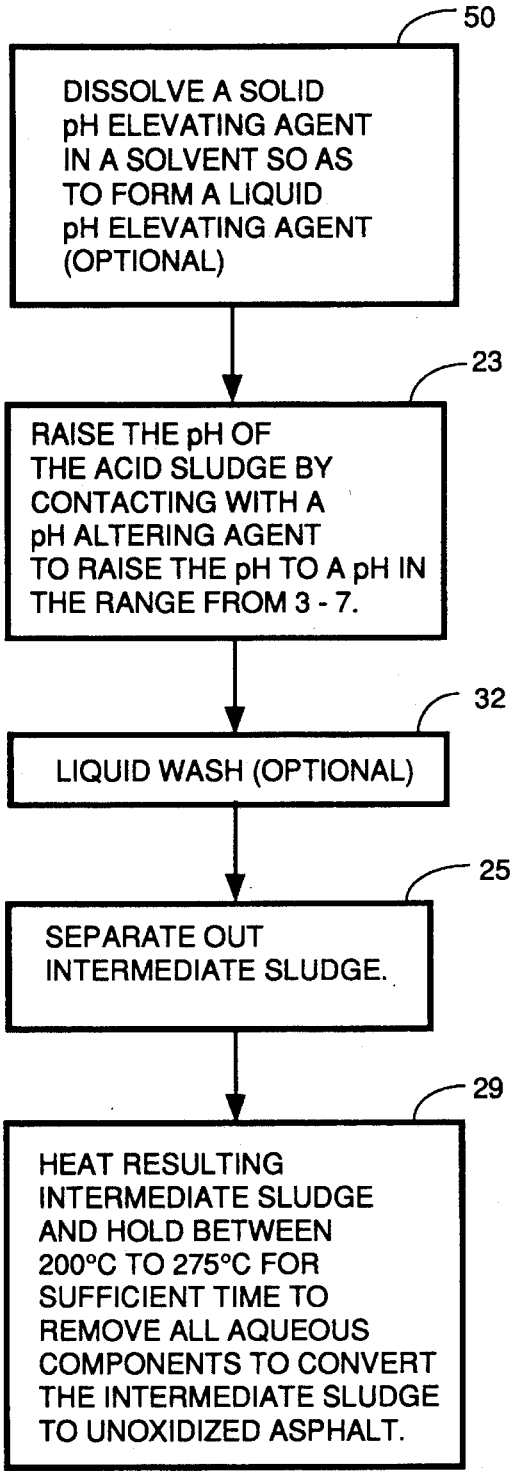
FIG. 9 is a flow chart of a process for using solid pH altering agent in a process to convert intermediate sludge into soft asphalt.

Referring to FIG. 9, there is shown a flow chart of a process to make soft, un-oxidized asphalt from acid sludge using a solid pH elevating agent. The process starts with optional process step 50. Step 50 involves dissolving in a solvent a solid pH elevating agent such as any base selected from the group consisting of lime, caustic soda, or soda ash, or any other inorganic solid with a pH higher than 3 after said solid pH elevating agent is dissolved in any solvent such as water. The reason that this step is optional is that when any base reacts with an acid, one by-product is water, and water helps the process of thoroughly mixing the pH elevating substance with the acid sludge. Mixing the solid pH elevating substance with a solvent before mixing the resulting liquid pH elevating substance into the acid sludge improves the mixing dispersion of the pH elevating agent in the acid sludge and leads to a more complete reaction. For that reason, step 50 is part of the preferred process especially for bases that do not generate enough water by the reaction with the acid sludge to thoroughly disperse the pH elevating substance within the acid sludge.

Step 23 represents the process of contacting the appropriate volume of pH elevating substance, either liquid or solid, with the acid sludge to raise the pH thereof to a pH in the range from 3–7 so as to prevent the acid sludge from becoming sandy and un-meltable at temperatures from room temperature up to approximately 275 degrees centigrade. This creates an intermediate mixture comprising a layer of liquid and a layer of intermediate sludge having a pH in the range from 3–7.

Step 32 is optional. This step involves a liquid wash of the resulting product of step 23. Although not necessary to make intermediate sludge suitable for the production of asphalt or to make asphalt, a liquid wash will remove salts which are formed by the reaction of the base pH elevating agent with the acid sludge.

Step 25 represents the process of separating the liquid from the intermediate sludge by the methods previously described.

Finally, soft un-oxidized asphalt can be formed from the intermediate sludge by heating the intermediate sludge to a temperature above the boiling point of water, preferably between 200° C. and 275° C., and holding the temperature there for a time sufficient to eliminate all the aqueous components.

Figure 10:
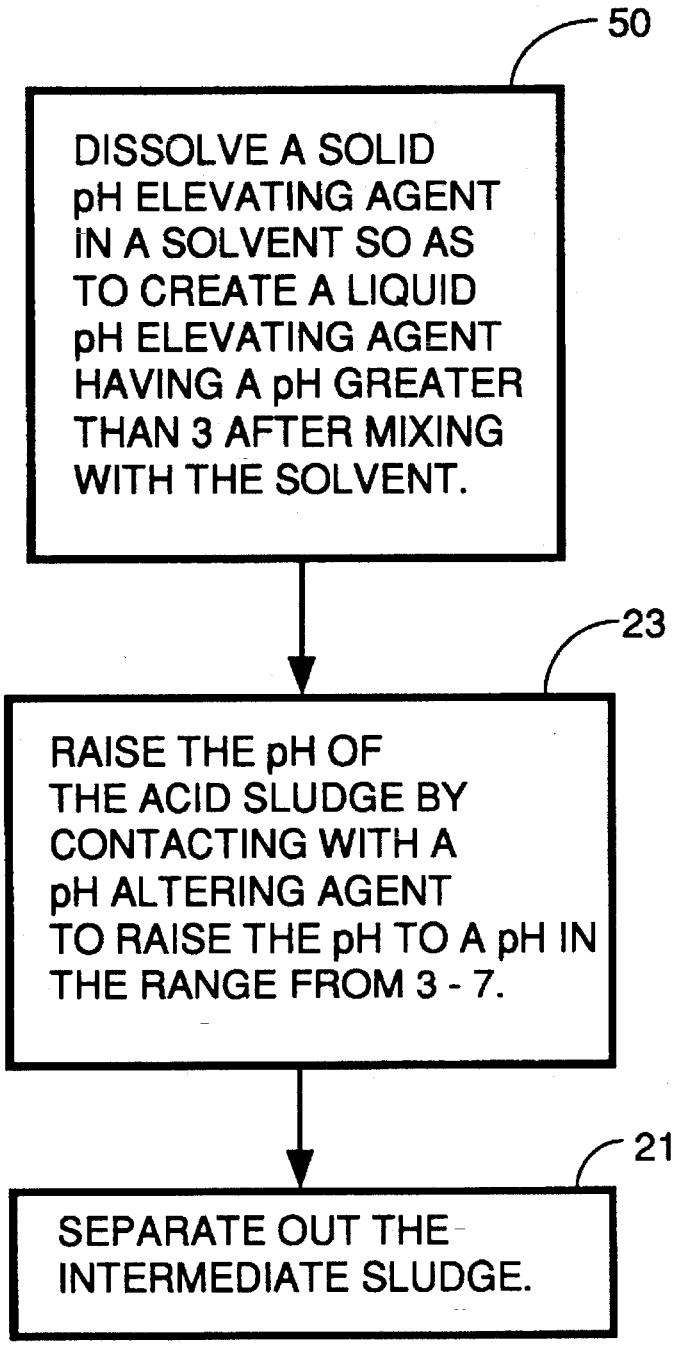
FIG. 10 is a flow chart of a process for using solid pH altering agent in a process to convert acid sludge to intermediate sludge.

FIG. 10 represents a process by which intermediate sludge may be formed from acid sludge using solid pH elevating agents. The steps of this process are identical to steps 50, 23 and 21 of the process of FIG. 9. The process only differs from the process of FIG. 9 by the elimination of the drying step 29. The intermediate sludge is useful in making both soft and hard asphalt and a number of other derivative products such as vapor barrier, primer coating for road construction, waterproofing materials, etc.

Figure 11:
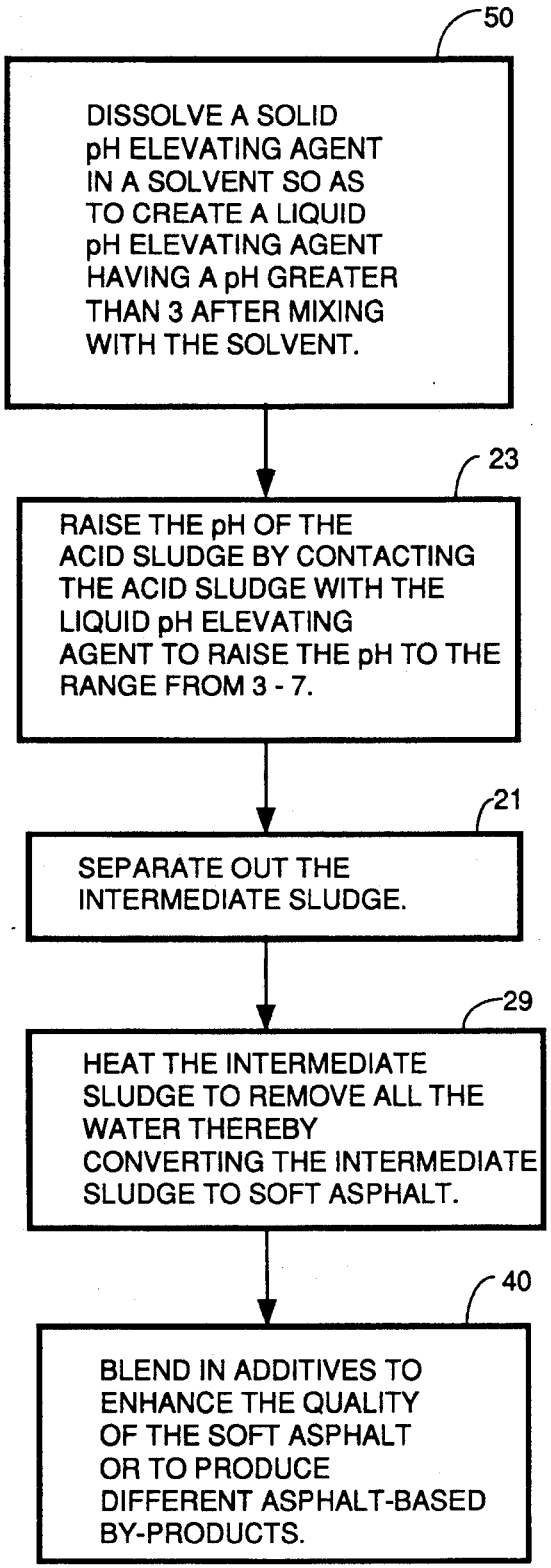
FIG. 11 is a flow chart of a process of converting acid sludge to soft asphalt either with or without the addition of additives and using a solid pH altering agent.

FIG. 11 represents a process by which intermediate sludge may be formed from acid sludge using solid pH elevating agents. The process involves dissolving a solid pH elevating agent in a solvent so as to form a liquid pH elevating agent at the outset as represented by step 50. This step is optional because most or all of the solid pH elevating agents create water when they react with the acid sludge. Next, the pH elevating agent is reacted with the acid sludge by mixing the solid or liquid pH elevating agent in with the acid sludge. Ultimately this creates a liquid layer and an intermediate sludge layer. The intermediate sludge is then separated out in step 21 and heated in step 29 to a temperature high enough and for an interval long enough to evaporate out all the water. This converts the intermediate sludge to soft, un-oxidized asphalt. Finally, additives such as virgin asphalt, ground up used tires, solvents or water and emulsifier etc. may be optionally added to the soft asphalt to create other products such as vapor barriers, undercoating, primer coats under road top surfaces, etc. as symbolized by step 40.

Although the invention has been described in terms of the preferred and alternative embodiments disclosed herein, those skilled in the art will appreciate many variations, modifications and enhancement which fall within the spirit and scope of the invention as defined in the claims appended hereto. All such modifications and enhancements are intended to be included within the scope of the claims appended hereto.

What is claimed is:

1. A process for converting acid sludge to un-oxidized asphalt, comprising:

altering the pH of the acid sludge by adding a pH elevating agent to said acid sludge, said pH elevating agent having a pH ranging from 3–14, said volume and pH of said pH elevating agent being sufficient to raise the pH of said acid sludge to from approximately 3 to approximately 7 such that the acid sludge does not become sandy and un-meltable at temperatures from room temperature up to approximately 275 degrees centigrade, thereby creating an intermediate mixture comprising a layer of liquid and a layer of intermediate sludge having a pH in the range from 3–7, and;

separating said liquid layer from said layer of intermediate sludge; and heating said intermediate sludge to a temperature sufficient to evaporate the water content of said intermediate sludge and holding said intermediate sludge at an elevated temperature above the boiling point of water for a time sufficient to evaporate substantially all the water content of said intermediate sludge thereby converting the intermediate sludge to a soft, un-oxidized asphalt.

2. The process of claim 1 further comprising the step of heating the intermediate sludge to a temperature of between 120° C. and 275° C.

3. The process of claim 1 wherein the step of altering the pH comprises the step of adding a liquid having a pH of from about 3 to 14.

4. The process of claim 1 wherein the pH elevating agent is water, and further comprising the step of adding an additive to the resulting soft un-oxidized asphalt to increase the adhesion thereof.

5. The process of claim 1 further comprising the step of adding an additive to said soft asphalt selected from the group consisting of virgin asphalt, rubber or rubber compounds, resins or polymers to increase the adhesion of the soft asphalt, petroleum distillate solvents suitable to produce cut back asphalt and water and emulsifier to produce emulsified asphalt.

6. A process for converting acid sludge to intermediate sludge useful in making either un-oxidized soft asphalt or oxidized hard asphalt, comprising:

dissolving a solid pH elevating agent in a solvent so as to form a liquid pH elevating agent, said solid pH elevating agent selected from the group consisting of lime, caustic soda, or soda ash, or calcium carbonate mixed in a solvent with the concentration of said calcium carbonate in said solvent and said solvent selected such that the resulting liquid has a pH higher than approximately 3;

altering the pH of the acid sludge by adding to said acid sludge a volume of said liquid pH elevating agent, said volume and pH of said liquid pH elevating agent being sufficient to raise the pH of said acid sludge to between approximately 3 to approximately 7 such that the acid sludge does not become sandy and un-meltable at temperatures from room temperature up to approximately 275 degrees centigrade, thereby creating an intermediate mixture comprising a layer of liquid and a layer of intermediate sludge having a pH in the range from 3–7, and;

separating said liquid layer from said layer of intermediate sludge.

7. The process of claim 6 further comprising the step of heating said intermediate sludge to a temperature sufficient to evaporate the water content of said intermediate sludge and holding said intermediate sludge at an elevated temperature above the boiling point of water for a time sufficient to evaporate substantially all the water content of said intermediate sludge thereby forming soft, un-oxidized asphalt.

8. The process of claim 6 further comprising washing said acid sludge after pH alteration to remove salts which result therein from the reaction of the base pH elevating agent with said acid sludge.

9. The process of claim 1 further comprising the step of heating the acid sludge while the pH elevating agent is in contact therewith but before separation of said layers, and further comprising the step of agitating the acid sludge at least during the interval when said pH altering material is in contact with said acid sludge but before separation of said layers.

10. The process of claim 7 further comprising the step of adding an additive to said soft asphalt selected from the group consisting of virgin asphalt, rubber or rubber compounds, resins or or polymers to increase the adhesion of the soft asphalt, petroleum distillate solvents suitable to produce cut back asphalt and water and emulsifier to produce emulsified asphalt.

11. The process of claim 1 further comprising washing said acid sludge after pH alteration to remove salts which result therein from the reaction of the base pH elevating agent with said acid sludge, and further comprising the step of adding an additive to said soft asphalt selected from the group consisting of virgin asphalt, rubber or rubber compounds, resins or or polymers to increase the adhesion of the soft asphalt, petroleum distillate solvents suitable to produce cut back asphalt and water and emulsifier to produce emulsified asphalt.

12. The process of claim 4 further comprising washing said acid sludge after pH alteration to remove salts which result therein from the reaction of the base pH elevating agent with said acid sludge, and wherein the step of adding an additive to said soft asphalt selected from the group consisting of virgin asphalt, rubber or rubber compounds, resins or or polymers to increase the adhesion of the soft asphalt, petroleum distillate solvents suitable to produce cut back asphalt and water and emulsifier to produce emulsified asphalt.

13. The process of claim 2 further comprising washing said acid sludge after pH alteration to remove salts which result therein from the reaction of the base pH elevating agent with said acid sludge, and wherein the step of adding an additive to said soft asphalt selected from the group consisting of virgin asphalt, rubber or rubber compounds, resins or or polymers to increase the adhesion of the soft asphalt, petroleum distillate solvents suitable to produce cut back asphalt and water and emulsifier to produce emulsified asphalt.

14. A process for converting acid sludge to intermediate sludge useful in making either un-oxidized soft asphalt or oxidized hard asphalt, comprising:

altering the pH of the acid sludge by adding to said acid sludge a volume of solid pH elevating agent selected from the group consisting of lime, caustic soda, or soda ash, said volume and pH of said solid pH elevating agent being sufficient to raise the pH of said acid sludge to between approximately 3 to approximately 7 such that the acid sludge does not become sandy and unmeltable at temperatures from room temperature up to approximately 275 degrees centigrade, thereby creating an intermediate mixture comprising a layer of liquid and a layer of intermediate sludge having a pH in the range from 3–7, and;

separating said liquid layer from said layer of intermediate sludge.

15. The process of claim 14 further comprising the step of heating the resulting intermediate sludge to a temperature above the boiling point of water and holding the temperature of said intermediate sludge above the boiling point of water until all the water has been evaporated from said intermediate sludge.

16. The process of claim 15 further comprising washing said acid sludge after pH alteration to remove salts which result therein from the reaction of the base pH elevating agent with said acid sludge, and wherein the step of adding an additive to said soft asphalt selected from the group consisting of virgin asphalt, rubber or rubber compounds, resins or polymers to increase the adhesion of the soft asphalt, petroleum distillate solvents suitable to produce cut back asphalt and water and emulsifier to produce emulsified asphalt.

17. The process of claim 15 further comprising the step of adding an additive to said soft asphalt selected from the group consisting of virgin asphalt, rubber or rubber compounds, resins or polymers to increase the adhesion of the soft asphalt, petroleum distillate solvents suitable to produce cut back asphalt and water and emulsifier to produce emulsified asphalt.

18. The process of claim 1 wherein the pH elevating agent is water, and further comprising the step of adding an additive to the resulting soft un-oxidized asphalt to convert the soft, un-oxidized asphalt to cut back asphalt.

19. The process of claim 1 wherein the pH elevating agent is water, and further comprising the step of adding an additive to the resulting soft un-oxidized asphalt to convert the soft, un-oxidized asphalt to emulsified asphalt.

* * * * *